United States Patent [19]

Misawa et al.

[11] Patent Number: 4,632,085

[45] Date of Patent: Dec. 30, 1986

[54] LUBRICATING OIL SUPPLY CONTROLLER

[75] Inventors: Mitsukuni Misawa, Tokyo; Osamu Sato, Fujimi, both of Japan

[73] Assignee: Honda Giken Kogyo Kabushiki Kaisha, Tokyo, Japan

[21] Appl. No.: 699,630

[22] Filed: Feb. 8, 1985

[30] Foreign Application Priority Data

Feb. 24, 1984 [JP] Japan ..... 59-33969

[51] Int. Cl.[4] ..... F02B 33/04

[52] U.S. Cl. ..... 123/73 AD; 123/73 A

[58] Field of Search ..... 123/73 AD, 73 A, 73 R

[56] References Cited

U.S. PATENT DOCUMENTS

| | | | |
|---|---|---|---|
| 3,180,329 | 4/1965 | Alt et al. | 123/73 AD |
| 3,212,485 | 10/1965 | Werner et al. | 123/73 AD |
| 3,447,519 | 6/1969 | Marcik et al. | 123/73 AD |
| 4,300,489 | 11/1981 | Perrin | 123/73 AD |
| 4,369,743 | 1/1983 | Holt et al. | 123/73 AD |

*Primary Examiner*—E. Rollins Cross

*Attorney, Agent, or Firm*—Armstrong, Nikaido, Marmelstein & Kubovcik

[57] ABSTRACT

A lubricating oil supply controller for a two-cycle engine is disclosed, wherein a lubricating oil is supplied to an intake air passage separately from fuel without mixing in advance the lubricating oil with fuel which is to be supplied to an engine. In this controller, a non-contacting type electrometer provided at a carburetor detects the fuel supply flow rate as a voltage. Thus detected voltage value is transmitted to a computer as a digital input through an analog-to-digital converter. This computer operates calculation by serving the input as a parameter and transmits a desired digital control signal to a step motor. The step motor is operated in response to the digital control signal and control a lubricating oil injection valve. In this way, the lubricating oil in its proper flow rate according to fuel supply flow rate is supplied to the engine.

4 Claims, 3 Drawing Figures

LUBRICATING OIL SUPPLY CONTROLLER

BACKGROUND OF THE INVENTION

This invention relates to a lubricating oil supply controller for a two-cycle engine wherein a lubricating oil can be fed to an intake air passage separately from fuel and without mixing in advance a lubricating oil with fuel which is to be fed to an engine.

In a conventional two-cycle gasoline engine, it is a usual practice that a lubricating oil is mixed with gasoline in advance and thereafter, the lubricating oil is jetted into an intake air passage together with gasoline through a carburetor.

However, if a lubricating oil should be mixed with gasoline, the gasoline which flows through a fuel supply system within the carburetor is reduced to the extent of the amount of lubricating oil mixed therewith. Therefore, in order to compensate for the reduced amount of gasoline, the fuel supply system is required to be formed large.

On the other hand, the carburetor is preferably made somewhat small compared with the engine of a given size and output since in this way, it is easy to supply fuel with proper air fuel ratio in the range from its low speed to high speed driving. As the carburetor becomes large in the size, there is a tendency that the range within which fuel with suitable air fuel ratio can be supplied becomes narrow.

Because of the above reason, another lubricating oil supplier is developed wherein only gasoline is jetted from the carburetor and a lubricating oil is separately delivered into an intake air passage. However, since this supplier is such designed as that the supplying amount of the lubricating oil is in proportion to the number of revolution of an engine, it cannot respond to the supplying amount of gasoline which is supplied in proportion to not only the number of rotation of the engine but also the opening degree of a throttle valve. If the supplying amount of the lubricating oil is set to be that much as to avoid the occurence of the shortage of the lubricating oil in any operating condition, white smoke is likely produced in exhaust gas.

The present invention is accomplished in view of the above.

SUMMARY OF THE INVENTION

It is therefore a general object of the present invention to provide a lubricating oil supply controller for a two-cycle engine wherein such disadvantage as mentioned above is overcome and the lubricating oil can be appropriately supplied in response to the supply flow rate of fuel.

The supplier according to the present invention includes fuel flow rate detecting means for detecting a supply flow rate of fuel; lubricating oil supplying means for supplying a lubricating oil to an intake air passage; and lubricating oil flow rate controlling means for controlling the lubricating oil supply flow rate of said lubricating oil supplying means in response to an input from said fuel flow rate detecting means.

Consequently, the supplier according to the present invention can supply the lubricating oil to the engine at the most appropriate supply flow rate according to the fuel supply flow rate.

Furthermore, according to the present invention, since the fuel and lubricating oil can be separately supplied to the engine respectively, the lubricating oil can be appropriately supplied to the engine according to the operating condition thereof.

DETAILED DESCRIPTION OF THE EMBODIMENT

Figure 1:
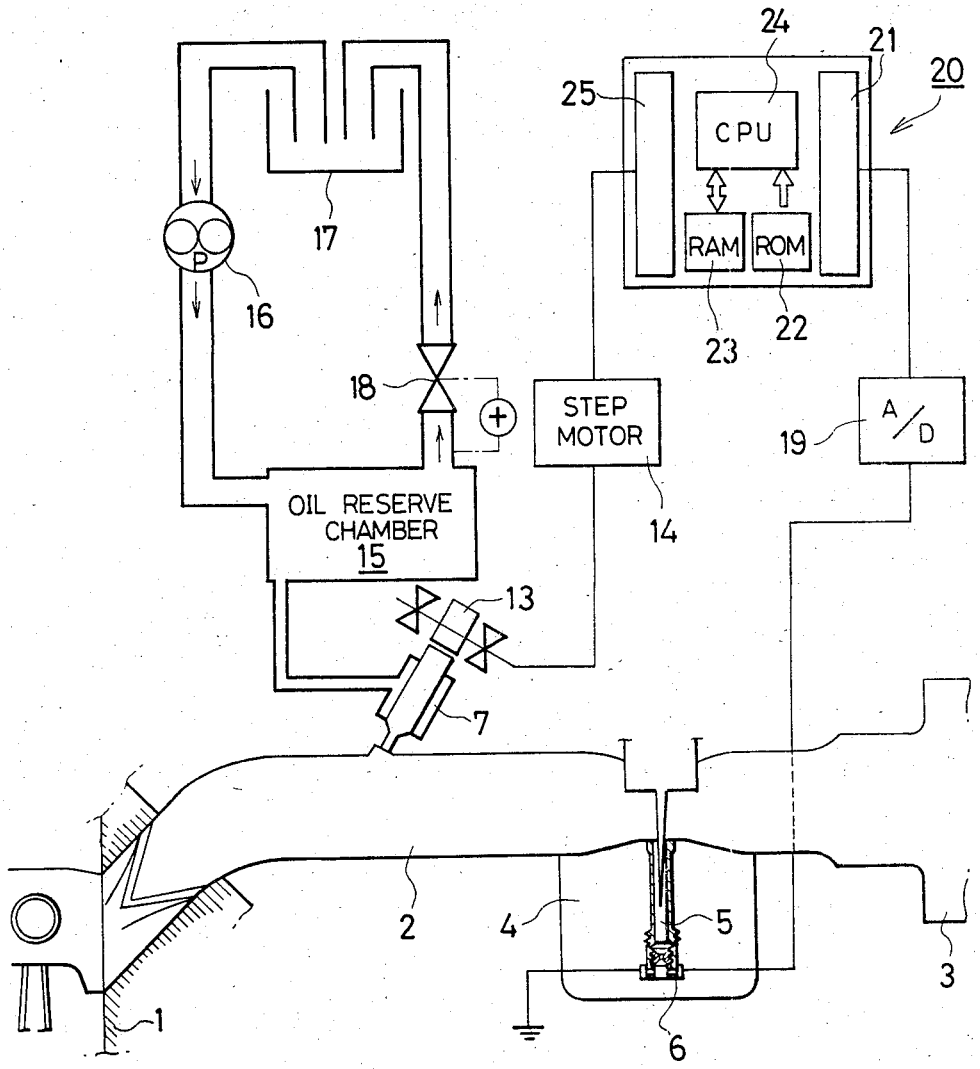
FIG. 1 is a schematic view showing the outline of a lubricating oil supply controller for a two-cycle engine according to one embodiment of the present invention.
Figure 2:
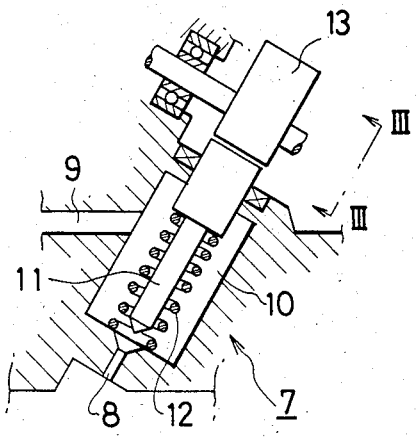
FIG. 2 is a vertical sectional side view, partly enlarged, of the above.
Figure 3:
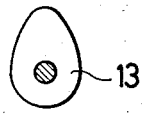
FIG. 3 is a view when viewed in the direction as shown by arrows III—III of FIG. 2.

A preferred embodiment of the present invention will be described hereunder with reference to the accompanying drawings.

1 denotes a two-cycle gasoline engine. An air cleaner 3 is connected to said engine 1 through an intake air passage 2 within which a variable venturi carburetor 4 is disposed. A non-contact type electrometer 6 is provided at a main jet 5 within said carburetor 4. As a result, the flow rate of gasoline jetted to the intake air passage 2 from the main jet 5 can be detected by means of the output of said non-contact type electrometer 6.

A discharge port of an injection valve 7 is formed at the downstream side of said variable venturi carburetor 4 within said intake air passage 2. Said injection valve 7 is connected to an oil reserve chamber 15. A pressurized lubricating oil is supplied into the oil reserve chamber 15 by an oil pump 16 driven by the engine 1 from an oil tank 17 and the lubricating oil is returned to the oil tank 17 from the oil reserve chamber 15 through a relief valve 18. As a result, the pressure of the lubricating oil within the oil reserve chamber 15 is maintained to be constant as set by said relief valve 18.

Said injection valve 7 comprises a chamber 10 having an injection nozzle 8 communicating with said intake air passage 2 and an inlet port 9 communicating with said oil reserve chamber 15, a needle 11 adapted to openably seal tight said injection nozzle 8, and a coiled spring 12 adapted to bias said needle 11 in its opening direction. The jetting rate of the lubricating oil is specified according to the angle of rotation of a cam 13 contacting the upper end of said needle 11. Especially, said lubricating oil is stopped jetting when the cam top is brought to contact with the upper end of said needle 11.

Furthermore, said cam 13 is connected to a step motor 14 through a reduction gear with large reduction ratio. The angle of rotation of said cam 13 is determined in accordance with the number of steps of said step motor 14.

19 denotes an analog-to-digital converter adapted to A/D convert an analog detection signal of said non-contact type electrometer 6 to a digital signal.

A microcomputer 20 comprises an input interface 21, a ROM 22, a RAM 23, a CPU 24 and an output interface 25. Said input interface 21 adequately processes the digital signal from said A/D converter 19 and inputs it to the CPU 24.

An operation program is stored in said ROM 22 in order to effect a proportional plus derivative operation by serving the digital signal from said A/D signal as a variable and to obtain a required sign pulse for transmitting to said step motor 14.

Said RAM 23 is designed in such a manner as to read and write the digital signal from said AD converter 19 and the data obtained in the process of said operation.

On the other hand, said CPU 24 is designed in such a manner as to sample the digital signal from said A/D converter 19 at every predetermined time, to obtain a value in proportion thereto and a variation thereof per minor period of time, to determine the number of positive or negative pulses to be given to said step motor 14, and to output the control pulse signal to the step motor 14 through said output interface 25.

Since the illustrated embodiment is constituted as described above, when the jetting rate of gasoline to the intake air passage 2 from the main jet 5 of said variable venturi carburetor 4 is changed by operating said carburetor 4, the flow rate of gasoline at said main jet 5 is detected as a voltage by the non-contact type electrometer 6 sensing the flow velocity, and the value of said voltage is converted into a digital value by the A/D converter 19.

The digital value corresponding to said flow rate of gasoline is sampled at each predetermined time interval, and a value in proportion thereto and a variation per said minor period of time are calculated. Further, a difference between the lubricating oil supply value corresponding to the opening degree of the injection valve 7 set in accordance with the angle of rotation of the step motor 14 and said calculated value is obtained. Then, such a pulse as to make said difference zero is applied to the step motor 14 by the output interface 25. As a result, said step motor 14 is rotated for suitable angles. In this way, a lubricating oil in proportion to the flow rate of gasoline which was supplied to the intake air passage 2 by the carburetor 4 is supplied to the intake air passage 2 by the injection valve 7.

As described in the foregoing, according to the above embodiment, a certain amount of a lubricating oil which is in proportion to the flow rate of gasoline jetted to the intake air passage 2 can be supplied to the intake air passage 2 by the injection valve 7.

Also, according to the above embodiment, since the variation of the flow rate of gasoline per minor period of time is calculated as a control input signal, the supply rate of the lubricating oil can be instantly increased or decreased according to the increase or decrease of the flow rate of gasoline.

In this way, since it is not required to set the supply rate of the lubricating oil larger than what is actually required with respect to the supply rate of gasoline, the consumption of the lubricating oil can be decreased as much as possible and the exhaust gas can be prevented from becoming white smoke.

Furthermore, since the carburetor 4 injects only gasoline, it can be made small in its size thus enabling to adequately supply the gasoline in a wide driving range.

In the above embodiment, the lubricating oil is supplied in proportion to the flow rate of gasoline. In other words, the lubricating oil is supplied by maintaining the mixing ratio between the gasoline and lubricating oil constant. Alternatively, if such an operation program as to change the mixing ratio between the gasoline and lubricating oil according to the flow rate of gasoline is stored in the ROM 22 of the microcomputer 20, the lubricating oil can be supplied at the mixing ratio between the gasoline and lubricating oil corresponding to the flow rate of gasoline.

Furthermore, in the above embodiment, only flow rate of gasoline is employed as a lubricating oil supply control input parameter. Alternatively, the number of rotation of the engine 1, the temperature of the engine, etc. can be employed as an input parameter.

What is claimed is:

1. In a two-cycle engine for supplying a mixture of air and fuel to a combustion chamber, a lubricating oil supply controller for the two-cycle engine comprises:

fuel flow rate detecting means for detecting a supply flow rate of fuel which is a non-contact type electrometer provided at a main jet of a carburetor;

lubricating oil supplying means for supplying a lubricating oil to an intake air passage; and lubricating oil flow rate controlling means for controlling the lubricating oil supply flow rate of said lubricating oil supplying means in response to an input from said fuel flow rate detecting means.

2. A lubricating oil supply controller according to claim 1 further including an analog-to-digital converter adapted to convert an analog signal from said non-contact type electrometer to a digital signal.

3. A lubricating oil supply controller according to claim 1, wherein said lubricating oil supply means is an injection valve opened up downstream of a carburetor within said intake air passage of said engine.

4. A lubricating oil supply controller according to claim 1 wherein said lubricating oil flow rate controlling means comprises a computer adapted to effect a proportional plus derivative operation to a detection input signal from said fuel flow rate detecting means in order to transmit a required control signal, and a step motor adapted to control said lubricating oil supply means by responding to said control signal.

* * * * *